United States Patent [19]

Sprengers

[11] 4,441,045

[45] Apr. 3, 1984

[54] LOW-PRESSURE SODIUM VAPOR DISCHARGE LAMP

[75] Inventor: Leo M. Sprengers, Eindhoven, Netherlands

[73] Assignee: U.S. Philips Corporation, New York, N.Y.

[21] Appl. No.: 497,215

[22] Filed: May 25, 1983

Related U.S. Application Data

[63] Continuation of Ser. No. 195,536, Oct. 9, 1980, abandoned.

[30] Foreign Application Priority Data

Nov. 14, 1979 [NL] Netherlands ..... 7908311

[51] Int. Cl.[3] ..... H01J 61/22; H01J 61/34; H01J 61/35

[52] U.S. Cl. ..... 313/25; 313/112; 313/634; 313/638; 313/573

[58] Field of Search ..... 313/25, 112, 634, 638, 313/573

[56] References Cited

U.S. PATENT DOCUMENTS

| | | | |
|---|---|---|---|
| 2,875,358 | 2/1959 | Rigden | 313/25 |
| 3,221,198 | 11/1965 | Van Der Wal et al. | 313/25 |
| 4,129,800 | 12/1978 | Van Benthem et al. | 313/25 |

*Primary Examiner*—Palmer C. Demeo
*Attorney, Agent, or Firm*—Robert S. Smith

[57] ABSTRACT

Low-pressure sodium vapor discharge lamp. The lamp comprises a cylindrical discharge tube and an outer bulb enveloping this tube. The outer bulb has a transparent layer which reflects infrared radiation.

According to the invention the resistance per square of the infrared reflecting layer is approximately 5 ohm. A luminous efficacy of 100 lumen per watt can be obtained at a lamp power of 8 watts. The lamp is particularly suitable for security lighting.

4 Claims, 1 Drawing Figure

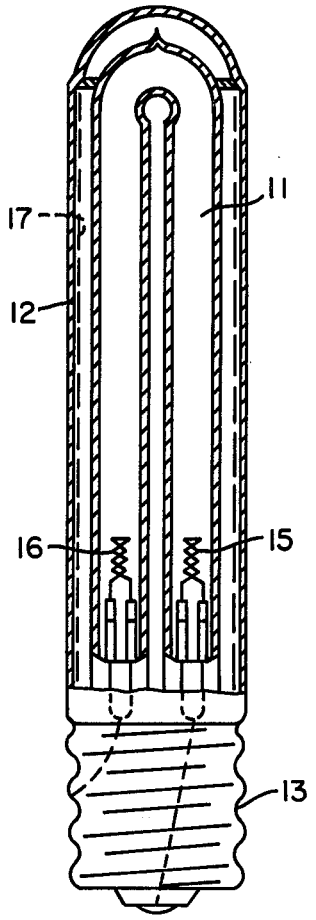
11
17
12
16
15
13

LOW-PRESSURE SODIUM VAPOR DISCHARGE LAMP

This is a continuation, of application Ser. No. 195,536 filed Oct. 9, 1980, and now abandoned.

The invention relates to a low-pressure sodium vapour discharge lamp for a power of not more than 25 watts, the lamp comprising an elongate discharge tube and and an outer bulb enveloping this discharge tube, the discharge tube having an arc voltage of at least 60 volts, a substantially circular cross-section, and two internal main electrodes one near each end, the outer bulb being coated with an infrared radiation-reflecting layer predominantly consisting of indium oxide, the thickness of that reflecting layer being not more than 0.5 micron.

A known low-pressure sodium vapor discharge lamp of the type defined above is described in, for example, United Kingdom patent specification No. 1,558,016. This lamp is generally used for security lighting, for example for the driveway area leading to a garage.

A lamp for security lighting should have a high luminous efficacy N (in lumen per watt) in combination with a lower power W (in watts). That is to say the product: $N \cdot 1/W = E$ should be large. E must be considered as a measure for energy saving.

The above-described known lamp has indeed a sufficiently high luminous efficacy N, of the order of approximately 100 lumen per watt, but the wattage W is rather high—namely 18 watt—, so that $E = N \cdot (1/W)$ is approximately 6. The luminous flux in lumens of that known lamp is therefore often too high for the above-mentioned use of that lamp.

The invention has for its object to provide a lamp of the type defined above whose luminous efficacy N is at least of the order to 100 lumen per watt, the product $N \cdot 1/W = E$ being at least 10.

The invention accordingly provides a low-pressure sodium vapor discharge lamp having an operating power of not more than 25 watts, the lamp comprising an elongate discharge tube and an outer bulb enveloping the discharge tube, the discharge tube having an arc voltage of at least 60 volts, a substantially circular cross-section, and two internal main electrodes, one near each end, the outer bulb being coated with an infrared radiation-reflecting layer predominantly consisting of indium oxide, the reflecting layer being not more than 0.5 micron thick, characterized in that the inside diameter of the discharge tube is between 0.4 and 1.0 centimeters, and the electric resistance per square of the infrared radiation-reflecting layer is between 3 and 7 ohm.

This lamp has the advantage that, whilst maintaining a luminous efficacy N to the order of at least 100 lumen per watt, the product $N \cdot 1/W = E$ can be large.

By way of explanation, the invention is inter alia based on the recognition of the fact that reducing the inside diameter of the discharge tube to below 1 centimeter—at a constant power W of the lamp—means that the distance between the main electrode has to be increased, but the joint effect of these dimensional changes results in a reduction of the volume of the discharge tube. This is connected with the fact that the wall load of the discharge tube is kept substantially constant. That lower volume combined with an electric resistance per square between 3 and 7 ohm of the infrared radiation-reflecting layer, accomplishes a very good preservation of the heat in the discharge tube. Such a layer is a satisfactory compromise between a high transparency to sodium light and a high reflection for infrared radiation. As known, in a lamp of the type defined in the opening paragraph an operating temperature of approximately 245° to 265° C. must be realized in the discharge tube to obtain an optimum conversion of electric energy into sodium radiation.

Higher powers (in excess of 25 watts) for low-pressure sodium vapor discharge lamps of a type having the the above-indicated combination of a low resistance per square of 3 to 7 ohm of the infrared radiation-reflecting layer and a small diameter of 0.4 to 1 cm of the discharge tube, would result in exceeding of the optimum operating temperature of 245° to 265° C.; so causing the luminous efficacy N to decrease. It is not possible to obtain a high E-value in such a case where W is high and N is low.

The relatively narrow discharge tube of a lamp according to the invention has the additional advantage that the outer bulb may also be of a small diameter. This makes it possible to use the lamp also in a shallow luminaire, which comprises, for example, a reflector.

An inside diameter of the discharge tube smaller than 0.4 cm might give rise to problems when inserting the main electrodes.

An electric resistance per square of the infrared radiation-reflecting layer exceeding 7 ohm results in a less satisfactory reflection of infrared radiation. With a resistance per square below 3 Ohm the drawback occurs that the transparency to sodium light is reduced to such an extent that the luminous efficacy N decreases.

An arc voltage of at least 60 volts, combined with a lamp power of not more than 25 watts, implies a relative low lamp current. As a result the electrode losses are relatively low, which promotes an increase of the luminous efficacy N.

It should be noted that in Applicant's prior, non-prepublished United Kingdom patent application No. 79200666 (Ser. No. 0011346 A), a low-pressure sodium vapor discharge lamp has been proposed for a power of not more than 25 watts, the discharge tube containing inter alia a particular rare gas mixture consisting, for example, of 95% by volume of helium with 5% by volume of krypton. That lamp also combines a relatively high luminous efficacy N with a low wattage W, but the product $N \cdot 1/W$ still remains below the value 10. In addition, that lamp has a discharge tube with a diameter of approximately 1.5 centimeters.

In an embodiment of a low-pressure sodium vapor discharge lamp according to the invention the electric resistance per square of the infrared radiation-reflecting layer is substantially 5 ohm. This embodiment has the advantage that the luminous efficacy N is then substantially at its maximum.

In a further embodiment of a low-pressure sodium vapor discharge lamp according to the invention the inside diameter of the discharge tube is between 0.6 and 0.8 cm and the distance between the main electrodes axially of the discharge tube is between 10 and 14 cm. This embodiment has the advantage that a high value of $E = N \cdot 1/W$ can be realized with a very compact lamp.

An embodiment of the invention will now be explained with reference to the accompanying drawing, the sole FIGURE of which shows an 8-watt low-pressure sodium vapor discharge lamp according to the invention. The lamp illustrated is approximately 15 cm long.

Referring to the FIGURE, reference numeral 11 denotes a U-shaped discharge tube. This tube 11, which is of a circular cross-section, is located inside a glass outer bulb 12 of a circle-cylindrical shape. Reference numeral 13 denotes a lamp base of this low-pressure sodium vapor discharge lamp. Numerals 15 and 16 denote electrodes arranged in respective ends of the discharge tube 11. These electrodes are connected to current supply elements of the lamp base 13. The inside of the wall of the outer bulb 12 is coated with a layer 17, which predominantly consists of indium oxide and is transmissive to sodium light but reflects infrared radiation. In addition, the layer 17 is doped with 7.1 atom % of tin relative to the number of indium atoms. The layer 17 is approximately 0.4 micron thick and its resistance per square is approximately 5 ohm. The diameter of the outer bulb 12 is approximately 3 cm. The inside diameter of each of the legs of the discharge tube is approximately 0.7 cm. Measured along the discharge path the distance between the electrodes is approximately 12 cm.

In addition to an excess of sodium the discharge tube 11 contains a rare gas, namely neon with 1% of argon. The pressure of the rare gas is approximately 2000 Pascal.

The lamp that has been described is designed for connection to an line voltage of approximately 220 volts, 50 Hertz via an inductive stabilization ballast, not shown, of approximately 5.8 Henry. A starter, for example a glow-discharge starter (not shown) which is connected in parallel with the lamp is used to ignite the lamp.

In the described circuit the current in the lamp is approximately 120 mAmperes in its operating condition. The arc voltage is approximately 70 volts.

The temperature of the coldest spot in the discharge tube 11 is approximately 255° C.

For the above-mentioned lamp power of 8 watt this lamp produces a luminous flux of approximately 800 lumen. This means a luminous efficacy N of 100 lumen per watt. As a result thereof $E=N\cdot 1/W=100\cdot 1/8=12.5$, that is to say relatively high compared with $E=6$ for the known lamp referred to above.

This lamp according to the invention has—as can be derived from the foregoing—a power of not more than 25 watts, the discharge tube has a diameter between 0.4 and 1.0 centimeters and resistance per square of the infrared radiation-reflecting layer 17 is between 4 and 7 ohm.

The layer 17 may be applied to the inside of the outer bulb 12 in, for example, the following manner. A quantity of 4 $cm^3$ $SnCl_4$ is added to a solution of 100 g $InCl_3$ in 1 liter of n-butyl acetate ester. The solution is atomized with oxygen in an atomizer and the resulting aerosol is passed through the glass tube, which is then still open at both ends. This tube is the future outer bulb 12. That glass tube is situated on an oven plate having a temperature of approximately 500° C.

The aerosol jet is alternately introduced into the tube from one end and from the other end, until the layer has the desired thickness of 0.4 micron. The built-in doping is, as mentioned above, 7.1 atoms.% Sr/In. Thereafter the coated tube is heated in a container to 450° C.; thereafter the tube is evacuated to less than $13.10^{-3}$ Pascal ($10^{-4}$ torr) and then CO gas is passed through the tube at a pressure of approximately 2000 Pascal (15 torr). Evacuation is repeated after 30 minutes whereafter the tube is cooled.

The layer thus produced has a charge carrier density of $1.3\times 10^{21}/cm^3$. The plasma wavelength of this layer is approximately 1.1 micron. The resistance per square is approximately 5 ohm.

This method of producing—and applying—the layer 17 on its glass substrate generally corresponds to the method described in the United Kingdom patent specification No. 1,427,449.

The described low-pressure sodium lamp combines a relatively low power, of 8 watt, with a luminous efficacy of 100 lumen per watt. This makes this lamp very suitable for security lighting, for example near garages or in shops during the closing hours during the night.

What is claimed is:

1. A low-pressure sodium vapor discharge lamp having an operating power of not more than 25 watts, the lamp comprising an elongate discharge tube and an outer bulb enveloping the tube, the discharge tube having an arc voltage of at least 60 volts, a substantially circular cross-section, and first and second internal main electrodes disposed near the respective ends of the discharge tube, the outer bulb being coated with an infrared radiation-reflecting layer predominantly consisting of indium oxide, the reflecting layer being not more than 0.4 micron thick, the inside diameter of the discharge tube being between 0.4 and 1.0 cm and the electric resistance per square of the infrared radiation-reflecting layer has a value between 3 and 7 ohms.

2. A low-pressure sodium vapor discharge lamp as claimed in claim 1, characterized in that the electric resistance per square of the infrared radiation-reflecting layer is substantially 5 ohms.

3. A low-pressure sodium vapor discharge lamp as claimed in claim 1, characterized in that the inside diameter of the discharge tube is between 0.6 and 0.8 cm and the distance between the main electrodes measured along the axis of the discharge tube is between 10 and 14 cm.

4. A low-pressure sodium vapor discharge lamp as claimed in claim 2, characterized in that the inside diameter of the discharge tube is between 0.6 and 0.8 cm and the distance between the main electrodes measured along the axis of the discharge tube is between 10 and 14 cm.

* * * * *